US005942470A

United States Patent [19]

Norman et al.

[11] Patent Number: 5,942,470

[45] **Date of Patent: *Aug. 24, 1999**

[54] LUBRICANT COMPOSITIONS

[75] Inventors: Stephen Norman, Florissant, Mo.; Donald G. Campbell, Baton Rouge, La.; Gregory S. Conary, St. Louis, Mo.

[73] Assignee: Ethyl Petroleum Additives, Inc., Richmond, Va.

[ * ] Notice: This patent is subject to a terminal disclaimer.

[21] Appl. No.: 09/081,532

[22] Filed: May 19, 1998

Related U.S. Application Data

[63] Continuation of application No. 07/993,802, Dec. 11, 1992, abandoned, which is a continuation of application No. 07/525,134, May 17, 1990, abandoned.

[51] Int. Cl.[6] ..... C10M 141/10; C10M 141/06

[52] U.S. Cl. ..... 508/189; 508/192; 508/287; 508/433; 508/436; 508/527; 508/569; 252/77

[58] Field of Search ..... 508/189, 287

[56] References Cited

U.S. PATENT DOCUMENTS

| | | | |
|---|---|---|---|
| 3,254,025 | 5/1966 | LeSuer | 508/192 |
| 5,176,840 | 1/1993 | Campbell et al. | 252/49.6 |
| 5,225,093 | 7/1993 | Campbell et al. | 252/51.005 A |

FOREIGN PATENT DOCUMENTS 0 020 037 12/1980 European Pat. Off. .

OTHER PUBLICATIONS

Smalheer et al, "Lubricant Addititves", Section I–Chemistry of Addivites, pp. 1–11, Jan. 1967.

*Primary Examiner*—Ellen M. McAvoy
*Attorney, Agent, or Firm*—Dennis H. Rainear; Thomas Hamilton

[57] ABSTRACT

Gear oils and gear oil additive concentrates of enhanced positraction performance are described. They comprise: (i) at least one oil-soluble sulfur-containing extreme pressure or antiwear agent; (ii) at least one oil-soluble amine salt of a partial ester of an acid of phosphorus; and (iii) at least one oil-soluble succinimide of the formula

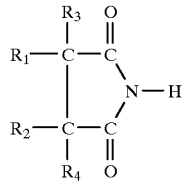

where $R_1$ is an alkyl or alkenyl group having an average of 8 to 50 carbon atoms, and each of $R_2$, $R_3$ and $R_4$ is a hydrogen atom or an alkyl or alkenyl group having an average of up to about 4 carbon atoms. These compositions preferably contain one, more preferably two, and most preferably all three of the following additional components: (iv) at least one amine salt of a carboxylic acid; (v) at least one nitrogen-containing ashless dispersant; and (vi) at least one trihydrocarbyl ester of a pentavalent acid of phosphorus.

10 Claims, No Drawings

LUBRICANT COMPOSITIONS

This is a continuation of copending application Ser. No. 07/993,802 filed on Dec. 11, 1992, now abandoned which is a continuation of Ser. No. 07/525,134 filed on May 17, 1990, now abandoned.

TECHNICAL FIELD

This invention relates to additive compositions adapted for use in manual transmission oils and in gear oils, and especially in rear axle lubricants to minimize noise and vibration that occasionally develop in limited slip axles. This invention also relates to manual transmission and gear oils containing such additive compositions.

BACKGROUND

Although a substantial number of gear oil additive concentrates are available in the marketplace, there exists a need for an additive to provide limited slip or enhanced positraction performance in a wide range of mineral and synthetic base gear oils. A most welcome contribution to the art would be the provision of an additive composition enabling present-day gear oil formulations to exhibit improved positraction performance in the GM limited slip axle chatter test (R-4A1-4), commonly referred to as the "big wheel, little wheel test".

Inasmuch as gear oils and manual transmission oils (collectively referred to hereinafter in the specification and in the claims as "gear oils") are subjected to prolonged usage in differentials and like devices, it is also important to provide additive systems capable of rendering improved service for long periods of time.

THE INVENTION

This invention provides additive compositions and gear oils capable of suppressing noise and vibration tending to occur in limited slip axles. Additionally, this invention provides additive systems capable of improving the performance of gear oils for long periods of time.

In one of its embodiments this invention provides a gear oil additive concentrate which comprises:

(i) at least one oil-soluble sulfur-containing extreme pressure or antiwear agent;

(ii) at least one oil-soluble amine salt of a partial ester of an acid of phosphorus; and (iii) at least one oil-soluble succinimide of the formula

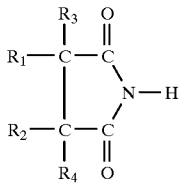

wherein $R_1$ is an alkyl or alkenyl group having an average of 8 to 50 carbon atoms, and each of $R_2$, $R_3$ and $R_4$ is, independently, a hydrogen atom or an alkyl or alkenyl group having an average of up to about 4 carbon atoms.

The proportions of (i):(ii):(iii) on a weight basis are as follows:

| Component | Preferred Range | More Preferred Range | Most Preferred Range |
|---|---|---|---|
| (i) | 1–5 | 1.5–4.5 | 2–4 |
| (ii) | 0.1–3 | 0.2–2 | 0.3–1 |
| (iii) | 0.05–4 | 0.1–2 | 0.2–1 |

Another embodiment of this invention is a gear oil composition comprising a major amount of a gear oil base stock containing a minor effective amount of components (i), (ii) and (iii) as above described.

Preferred gear oil additive concentrates and gear oil lubricant compositions are those additionally containing (iv) at least one oil-soluble amine salt of a carboxylic acid; or (v) at least one oil-soluble nitrogen-containing ashless dispersant; or (vi) at least one oil-soluble trihydrocarbyl ester of a pentavalent acid of phosphorus. More preferred are gear oil additive concentrates and gear oil lubricant compositions additionally containing (iv) at least one oil-soluble amine salt of a carboxylic acid and (v) at least one oil-soluble nitrogen-containing ashless dispersant; or (iv) at least one oil-soluble amine salt of a carboxylic acid and (vi) at least one oil-soluble trihydrocarbyl ester of a pentavalent acid of phosphorus; or (v) at least one oil-soluble nitrogen-containing ashless dispersant and (vi) at least one oil-soluble trihydrocarbyl ester of a pentavalent acid of phosphorus. Especially preferred are the gear oil additive concentrates and gear oil lubricant compositions which contain all of components (i), (ii), (iii), (iv), (v) and (vi).

Additional highly preferred embodiments of this invention comprise each and every one of the compositions referred to hereinabove which are further characterized by being substantially devoid of any metal-containing additive component. Besides enabling the achievement of desirable positraction performance, such essentially metal-free compositions make possible the provision of gear oils satisfying the requirements of the GL5 classification of the American Petroleum Institute. Thus the preferred lubricant compositions of this invention do not contain such metal-containing additives as the zinc dihydrocarbyldithiophosphates or the sulfonates, phenates, and/or sulfurized phenates of the alkali metals or of the alkaline earth metals, components which are almost universally employed in engine oils.

Component (i)

A wide variety of sulfur-containing extreme pressure or antiwear agents are available for use in the practice of this invention. Among suitable compositions for this use are included sulfurized animal or vegetable fats or oils, sulfurized animal or vegetable fatty acid esters, fully or partially esterified esters of trivalent or pentavalent acids of phosphorus, sulfurized olefins (see for example U.S. Pat. Nos. 2,995,569; 3,673,090; 3,703,504; 3,703,505; 3,796,661; 3,873,545; 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), sulfurized Diels-Alder adducts (see for example U.S. Pat. Nos. 3,632,566; 3,498,915; and Re 27,331), sulfurized dicyclopentadiene (see for example U.S. Pat. Nos. 3,882,031 and 4,188,297), sulfurized or co-sulfurized mixtures of fatty acid esters and monounsaturated olefin (see for example U.S. Pat. Nos. 4,149,982; 4,166,796; 4,166,797; 4,321,153 and 4,481,140), co-sulfurized blends of fatty acid, fatty acid ester and α-olefin (see for example U.S. Pat. No. 3,953,347), functionally-substituted dihydrocarbyl polysulfides (see for example U.S. Pat. No. 4,218,332), thia-aldehydes, thia-ketones and derivatives thereof (e.g. acids, esters, imines, lactones, etc.,) (see for example U.S. Pat. No. 4,800,031; and International Application Publication No. WO 88/03552), epithio compounds (see for example U.S. Pat. No. 4,217,233), sulfur-containing acetal derivatives (see for example U.S. Pat. No. 4,248,723), co-sulfurized blends of terpene and acyclic olefins (see for example U.S. Pat. No. 4,584,113), sulfurized borate compounds (see for example U.S. Pat. No. 4,701,274), and polysulfide olefin products (see for example U.S. Pat. No. 4,795,576). The disclosures of the foregoing patents are incorporated herein by reference.

Preferred materials useful as component (i) are sulfur-containing organic compounds in which the sulfur-containing species are bound directly to carbon or to more sulfur.

One particularly preferred class of such agents is made by reacting an olefin such as isobutene with sulfur. The product, e.g., sulfurized isobutene, typically has a sulfur content of about 10 to about 50%, preferably 30 to 50%, by weight. A wide variety of other olefins or unsaturated hydrocarbons, e.g., isobutene dimer or trimer, may be used to form such agents.

Another particularly preferred class of such agents is composed of one or more compounds represented by the formula $$R—S_x—R'$$

where R and R' are hydrocarbyl groups each of which preferably contains 3 to 18 carbon atoms and x is preferably in the range of from 2 to about 8, and more preferably in the range of from 2 to 5. The hydrocarbyl groups can be of widely varying types such as alkyl, cycloalkyl, alkenyl, aryl, aralkyl, etc. Tertiary alkyl polysulfides such as di-tert-butyl trisulfide, and mixtures comprising di-tert-butyl trisulfide (e.g. a mixture composed principally or entirely of the tri-, tetra-, and pentasulfides) are preferred. Examples of other useful dihydrocarbyl polysulfides include the diamyl polysulfides, the dinonyl polysulfides, the didodecyl polysulfides, and the dibenzyl polysulfides, among others.

Other particularly preferred sulfur-containing extreme pressure agent which may be used in the compositions of the invention are the sulfur- and phosphorus-containing additives already mentioned, especially the thiophosphates, dithiophosphates, trithiophosphates and tetrathiophosphates, e.g., the fully or partially esterified hydrocarbyl esters of the mono-, di-, tri-, and tetrathiophosphoric acids, and the amine salts of the partially esterified mono-, di-, tri-, and tetrathiophosphoric acids. The aforesaid hydrocarbyl groups may each typically contain 2 to 30, preferably 4 to 12, carbon atoms each.

Component (ii)

Component (ii) is composed of one or more oil-soluble amine salts of one or more partial esters of one or more acids of phosphorus, preferably one or more partial esters of one or more acids of pentavalent phosphorus. Such compounds may be represented by the formulas (I)

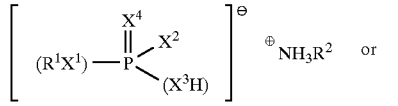

(II)

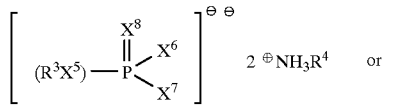

(III)

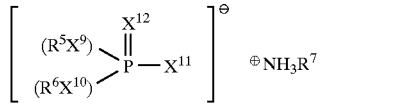

or mixtures thereof. In Formulas I, II and III, each of $R^1$, $R^2$, $R^3$, $R^4$, $R^5$, $R^6$, and $R^7$ is, independently, a hydrocarbyl group and each of $X^1$, $X^2$, $X^3$, $X^4$, $X^5$, $X^6$, $X^7$, $X^8$, $X^9$, $X^{10}$, $X^{11}$, and $X^{12}$ is, independently, an oxygen atom or a sulfur atom.

Suitable salts or amine adducts of the above partially esterified acids of pentavalent phosphorus include such compounds as:

Octylamine salt of O-monobutylphosphoric acid
Octylamine salt of O,O-dibutylphosphoric acid
Octylamine salt of S-monobutylthiophosphoric acid
Octylamine salt of O-monobutylthiophosphoric acid
Octylamine salt of O,S-dibutylthiophosphoric acid
Octylamine salt of O,O-dibutylthiophosphoric acid
Octylamine salt of O,S-dibutyldithiophosphoric acid
Octylamine salt of S,S-dibutyldithiophosphoric acid
Octylamine salt of O-monobutyldithiophosphoric acid
Octylamine salt of S-monobutyldithiophosphoric acid
Octylamine salt of S-monobutyltrithiophosphoric acid
Octylamine salt of S,S-dibutyltrithiophosphoric acid
Octylamine salt of O-monobutylthionophosphoric acid
Octylamine salt of O,O-dibutylthionophosphoric acid
Octylamine salt of S-monobutylthiothionophosphoric acid
Octylamine salt of O-monobutylthiothionophosphoric acid
Octylamine salt of O,S-dibutylthiothionophosphoric acid
Octylamine salt of O,O-dibutylthiothionophosphoric acid
Octylamine salt of O,S-dibutyldithiothionophosphoric acid
Octylamine salt of S,S-dibutyldithiothionophosphoric acid
Octylamine salt of O-monobutyldithiothionophosphoric acid
Octylamine salt of S-monobutyldithiothionophosphoric acid
Octylamine salt of S-monobutyltrithiothionosphoric acid
Octylamine salt of S,S-dibutyltrithiothionophosphoric acid
Octylamine salt of O-monoamylphosphoric acid
Octylamine salt of O,O-diamylphosphoric acid
Octylamine salt of S-monoamylthiophosphoric acid
octylamine salt of O-monoamylthiophosphoric acid
Octylamine salt of O,S-diamylthiophosphoric acid
Octylamine salt of O,O-diamylthiophosphoric acid
Octylamine salt of O,S-diamyldithiophosphoric acid
Octylamine salt of S,S-diamyldithiophosphoric acid
Octylamine salt of O-monoamyldithiophosphoric acid
Octylamine salt of S-monoamyldithiophosphoric acid
Octylamine salt of S-monoamyltrithiophosphoric acid
Octylamine salt of S,S-diamyltrithiophosphoric acid
Octylamine salt of O-monoamylthionophosphoric acid
Octylamine salt of O,O-diamylthionophosphoric acid
octylamine salt of S-monoamylthiothionophosphoric acid
Octylamine salt of O-monoamylthiothionophosphoric acid Octylamine salt of O,S-diamylthiothionophosphoric acid
Octylamine salt of O,O-diamylthiothionophosphoric acid
Octylamine salt of O,S-diamyldithiothionophosphoric acid
Octylamine salt of S,S-diamyldithiothionophosphoric acid
Octylamine salt of O-monoamyldithiothionophosphoric acid
Octylamine salt of S-monoamyldithiothionophosphoric acid
Octylamine salt of S-monoamyltrithiothionosphoric acid
Octylamine salt of S,S-diamyltrithiothionophosphoric acid
Octylamine salt of O-monohexylphosphoric acid
Octylamine salt of O,O-dihexylphosphoric acid
Octylamine salt of S-monohexylthiophosphoric acid
Octylamine salt of O-monohexylthiophosphoric acid
Octylamine salt of O,S-dihexylthiophosphoric acid
Octylamine salt of O,O-dihexylthiophosphoric acid
Octylamine salt of O,S-dihexyldithiophosphoric acid
Octylamine salt of S,S-dihexyldithiophosphoric acid
Octylamine salt of O-monohexyldithiophosphoric acid
Octylamine salt of S-monohexyldithiophosphoric acid
Octylamine salt of S-monohexyltrithiophosphoric acid
Octylamine salt of S,S-dihexyltrithiophosphoric acid
Octylamine salt of O-monohexylthionophosphoric acid
Octylamine salt of O,O-dihexylthionophosphoric acid
Octylamine salt of S-monohexylthiothionophosphoric acid
Octylamine salt of O-monohexylthiothionophosphoric acid
Octylamine salt of O,S-dihexylthiothionophosphoric acid
Octylamine salt of O,O-dihexylthiothionophosphoric acid
Octylamine salt of O,S-dihexyldithiothionophosphoric acid
Octylamine salt of S,S-dihexyldithiothionophosphoric acid
octylamine salt of O-monohexyldithiothionophosphoric acid
Octylamine salt of S-monohexyldithiothionophosphoric acid
Octylamine salt of S-monohexyltrithiothionosphoric acid
Octylamine salt of S,S-dihexyltrithiothionophosphoric acid
Octylamine salt of O-monoheptylphosphoric acid
Octylamine salt of O,O-diheptylphosphoric acid
Octylamine salt of S-monoheptylthiophosphoric acid
Octylamine salt of O-monoheptylthiophosphoric acid
Octylamine salt of O,S-diheptylthiophosphoric acid
Octylamine salt of O,O-diheptylthiophosphoric acid
Octylamine salt of O,S-diheptyldithiophosphoric acid
Octylamine salt of S,S-diheptyldithiophosphoric acid
Octylamine salt of O-monoheptyldithiophosphoric acid
Octylamine salt of S-monoheptyldithiophosphoric acid
Octylamine salt of S-monoheptyltrithiophosphoric acid
Octylamine salt of S,S-diheptyltrithiophosphoric acid
Octylamine salt of O-monoheptylthionophosphoric acid
Octylamine salt of O,O-diheptylthionophosphoric acid
Octylamine salt of S-monoheptylthiothionophosphoric acid
Octylamine salt of O-monoheptylthiothionophosphoric acid
Octylamine salt of O,S-diheptylthiothionophosphoric acid
Octylamine salt of O,O-diheptylthiothionophosphoric acid
Octylamine salt of O,S-diheptyldithiothionophosphoric acid
Octylamine salt of S,S-diheptyldithiothionophosphoric acid
Octylamine salt of O-monoheptyldithiothionophosphoric acid
Octylamine salt of S-monoheptyldithiothionophosphoric acid
Octylamine salt of S-monoheptyltrithiothionosphoric acid
Octylamine salt of S,S-diheptyltrithiothionophosphoric acid
Octylamine salt of O-mono-2-ethylhexylphosphoric acid
Octylamine salt of O,O-di-2-ethylhexylphosphoric acid
octylamine salt of S-mono-2-ethylhexylthiophosphoric acid
Octylamine salt of O-mono-2-ethylhexylthiophosphoric acid
Octylamine salt of O,S-di-2-ethylhexylthiophosphoric acid
Octylamine salt of O,O-di-2-ethylhexylthiophosphoric acid
Octylamine salt of O,S-di-2-ethylhexyldithiophosphoric acid
Octylamine salt of S,S-di-2-ethylhexyldithiophosphoric acid
Octylamine salt of O-mono-2-ethylhexyldithiophosphoric acid
Octylamine salt of S-mono-2-ethylhexyldithiophosphoric acid
Octylamine salt of S-mono-2-ethylhexyltrithiophosphoric acid
Octylamine salt of S,S-di-2-ethylhexyltrithiophosphoric acid
Octylamine salt of O-mono-2-ethylhexylthionophosphoric acid
Octylamine salt of O,O-di-2-ethylhexylthionophosphoric acid
Octylamine salt of S-mono-2-ethylhexylthiothionophosphoric acid
Octylamine salt of O-mono-2-ethylhexylthiothionophosphoric acid
Octylamine salt of O,S-di-2-ethylhexylthiothionophosphoric acid
Octylamine salt of O,O-di-2-ethylhexylthiothionophosphoric acid
Octylamine salt of O,S-di-2-ethylhexyldithiothionophosphoric acid
Octylamine salt of S,S-di-2-ethylhexyldithiothionophosphoric acid
Octylamine salt of O-mono-2-ethylhexyldithiothionophosphoric acid
Octylamine salt of S-mono-2-ethylhexyldithiothionophosphoric acid
Octylamine salt of S-mono-2-ethylhexyltrithiothionosphoric acid
Octylamine salt of S,S-di-2-ethylhexyltrithiothionophosphoric acid
Octylamine salt of O-monodecylphosphoric acid
Octylamine salt of O,O-didecylphosphoric acid
Octylamine salt of S-monodecylthiophosphoric acid
Octylamine salt of O-monodecylthiophosphoric acid
Octylamine salt of O,S-didecylthiophosphoric acid
Octylamine salt of O,O-didecylthiophosphoric acid
Octylamine salt of O,S-didecyldithiophosphoric acid
Octylamine salt of S,S-didecyldithiophosphoric acid
Octylamine salt of O-monodecyldithiophosphoric acid
Octylamine salt of S-monodecyldithiophosphoric acid
Octylamine salt of S-monodecyltrithiophosphoric acid
Octylamine salt of S,S-didecyltrithiophosphoric acid
Octylamine salt of O-monodecylthionophosphoric acid
Octylamine salt of O,O-didecylthionophosphoric acid
Octylamine salt of S-monbdecylthiothionophosphoric acid
Octylamine salt of O-monodecylthiothionophosphoric acid
Octylamine salt of O,S-didecylthiothionophosphoric acid
Octylamine salt of O,O-didecylthiothionophosphoric acid
Octylamine salt of O,S-didecyldithiothionophosphoric acid
Octylamine salt of S,S-didecyldithiothionophosphoric acid
Octylamine salt of O-monodecyldithiothionophosphoric acid
Octylamine salt of S-monodecyldithiothionophosphoric acid
Octylamine salt of S-monodecyltrithiothionosphoric acid
Octylamine salt of S,S-didecyltrithiothionophosphoric acid
Octylamine salt of O-monododecylphosphoric acid
Octylamine salt of O,O-didodecyliphosphoric acid
Octylamine salt of S-monododecylthiophosphoric acid
Octylamine salt of O-monododecylthiophosphoric acid
Octylamine salt of O,S-didodecylthiophosphoric acid Octylamine salt of O,O-didodecylthiophosphoric acid
Octylamine salt of O,S-didodecyldithiophosphoric acid
Octylamine salt of S,S-didodecyldithiophosphoric acid
octylamine salt of O-monododecyldithiophosphoric acid
Octylamine salt of S-monododecyldithiophosphoric acid
Octylamine salt of S-monododecyltrithiophosphoric acid
Octylamine salt of S,S-didodecyltrithiophosphoric acid
Octylamine salt of O-monododecylthionophosphoric acid
Octylamine salt of O,O-didodecylthionophosphoric acid
Octylamine salt of S-monododecylthiothionophosphoric acid
Octylamine salt of O-monododecylthiothionophosphoric acid
Octylamine salt of O,S-didodecylthiothionophosphoric acid
Octylamine salt of O,O-didodecylthiothionophosphoric acid
Octylamine salt of O,S-didodecyldithiothionophosphoric acid
Octylamine salt of S,S-didodecyldithiothionophosphoric acid
Octylamine salt of O-monododecyldithiothionophosphoric acid
Octylamine salt of S-monododecyldithiothionophosphoric acid
Octylamine salt of S-monododecyltrithiothionosphoric acid
Octylamine salt of S,S-didodecyltrithiothionophosphoric acid
Octylamine salt of O-monotetradecylphosphoric acid
Octylamine salt of O,O-ditetradecylphosphoric acid
Octylamine salt of S-monotetradecylthiophosphoric acid
Octylamine salt of O-monotetradecylthiophosphoric acid
Octylamine salt of O,S-ditetradecylthiophosphoric acid
Octylamine salt of O,O-ditetradecylthiophosphoric acid
Octylamine salt of O,S-ditetradecyldithiophosphoric acid
Octylamine salt of S,S-ditetradecyldithiophosphoric acid
Octylamine salt of O-monotetradecyldithiophosphoric acid
Octylamine salt of S-monotetradecyldithiophosphoric acid
Octylamine salt of S-monotetradecyltrithiophosphoric acid
Octylamine salt of S,S-ditetradecyltrithiophosphoric acid
Octylamine salt of O-monotetradecylthionophosphoric acid
Octylamine salt of O,O-ditetradecylthionophosphoric acid
Octylamine salt of S-monotetradecylthiothionophosphoric acid
Octylamine salt of O-monotetradecylthiothionophosphoric acid
Octylamine salt of O,S-ditetradecylthiothionophosphoric acid
Octylamine salt of O,O-ditetradecylthiothionophosphoric acid
Octylamine salt of O,S-ditetradecyldithiothionophosphoric acid
Octylamine salt of S,S-ditetradecyldithiothionophosphoric acid
Octylamine salt of O-monotetradecyldithiothionophosphoric acid
Octylamine salt of S-monotetradecyldithiothionophosphoric acid
Octylamine salt of S-monotetradecyltrithiothionosphoric acid
Octylamine salt of S,S-ditetradecyltrithiothionophosphoric acid
Octylamine salt of O-monotetradecylphosphoric acid
Octylamine salt of O,O-ditetradecylphosphoric acid
Octylamine salt of S-monotetradecylthiophosphoric acid
Octylamine salt of O-monotetradecylthiophosphoric acid
Octylamine salt of O,S-ditetradecylthiophosphoric acid
Octylamine salt of O,O-ditetradecylthiophosphoric acid
Octylamine salt of O,S-ditetradecyldithiophosphoric acid
Octylamine salt of S,S-ditetradecyldithiophosphoric acid
Octylamine salt of O-monotetradecyldithiophosphoric acid
octylamine salt of S-monotetradecyldithiophosphoric acid
Octylamine salt of S-monotetradecyltrithiophosphoric acid
octylamine salt of S,S-ditetradecyltrithiophosphoric acid
Octylamine salt of O-monotetradecylthionophosphoric acid
Octylamine salt of O,O-ditetradecylthionophosphoric acid
Octylamine salt of S-monotetradecylthiothionophosphoric acid
Octylamine salt of O-monotetradecylthiothionophosphoric acid
Octylamine salt of O,S-ditetradecylthiothionophosphoric acid
Octylamine salt of O,O-ditetradecylthiothionophosphoric acid
Octylamine salt of O,S-ditetradecyldithiothionophosphoric acid
Octylamine salt of S,S-ditetradecyldithiothionophosphoric acid
Octylamine salt of O-monotetradecyldithiothionophosphoric acid
Octylamine salt of S-monotetradecyldithiothionophosphoric acid
Octylamine salt of S-monotetradecyltrithiothionosphoric acid
Octylamine salt of S,S-ditetradecyltrithiothionophosphoric acid
Octylamine salt of O-monohexadecylphosphoric acid
Octylamine salt of O,O-dihexadecylphosphoric acid
Octylamine salt of S-monohexadecylthiophosphoric acid
Octylamine salt of O-monohexadecylthiophosphoric acid
Octylamine salt of O,S-dihexadecylthiophosphoric acid
Octylamine salt of O,O-dihexadecylthiophosphoric acid
Octylamine salt of O,S-dihexadecyldithiophosphoric acid
Octylamine salt of S,S-dihexadecyldithiophosphoric acid
Octylamine salt of O-monohexadecyldithiophosphoric acid
Octylamine salt of S-monohexadecyldithiophosphoric acid
Octylamine salt of S-monohexadecyltrithiophosphoric acid
Octylamine salt of S,S-dihexadecyltrithiophosphoric acid
Octylamine salt of O-monohexadecylthionophosphoric acid
Octylamine salt of O,O-dihexadecylthionophosphoric acid
Octylamine salt of S-monohexadecylthiothionophosphoric acid
Octylamine salt of O-monohexadecylthiothionophosphoric acid
Octylamine salt of O,S-dihexadecylthiothionophosphoric acid
Octylamine salt of O,O-dihexadecylthiothionophosphoric acid
Octylamine salt of O,S-dihexadecyldithiothionophosphoric acid
Octylamine salt of S,S-dihexadecyldithiothionophosphoric acid
Octylamine salt of O-monohexadecyldithiothionophosphoric acid
Octylamine salt of S-monohexadecyldithiothionophosphoric acid
Octylamine salt of S-monohexadecyltrithiothionosphoric acid
Octylamine salt of S,S-dihexadecyltrithiothionophosphoric acid
Octylamine salt of O-monooctadecylphosphoric acid
Octylamine salt of O,O-dioctadecylphosphoric acid
Octylamine salt of S-monooctadecylthiophosphoric acid
Octylamine salt of O-monooctadecylthiophosphoric acid
Octylamine salt of O,S-dioctadecylthiophosphoric acid
Octylamine salt of O,O-dioctadecylthiophosphoric acid Octylamine salt of O,S-dioctadecyldithiophosphoric acid
Octylamine salt of S,S-dioctadecyldithiophosphoric acid
Octylamine salt of O-monooctadecyldithiophosphoric acid
Octylamine salt of S-monooctadecyldithiophosphoric acid
Octylamine salt of S-monooctadecyltrithiophosphoric acid
Octylamine salt of S,S-dioctadecyltrithiophosphoric acid
Octylamine salt of O-monooctadecylthionophosphoric acid
Octylamine salt of O,O-dioctadecylthionophosphoric acid
Octylamine salt of S-monooctadecylthiothionophosphoric acid
Octylamine salt of O-monooctadecylthiothionophosphoric acid
Octylamine salt of O,S-dioctadecyltiiothionophosphoric acid
Octylamine salt of O,O-dioctadecylthiothionophosphoric acid
Octylamine salt of O,S-dioctadecyldithiothionophosphoric acid
Octylamine salt of S,S-dioctadecyldithiothionophosphoric acid
Octylamine salt of O-monooctadecyldithiothionophosphoric acid
Octylamine salt of S-monooctadecyldithiothionophosphoric acid
Octylamine salt of S-monooctadecyltrithiothionosphoric acid
Octylamine salt of S,S-dioctadecyltrithiothionophosphoric acid
Octylamine salt of O-monooleylphosphoric acid
Octylamine salt of O,O-dioleylphosphoric acid
Octylamine salt of S-monooleylthiophosphoric acid
octylamine salt of O-monooleylthiophosphoric acid
Octylamine salt of O,S-dioleylthiophosphoric acid
Octylamine salt of O,O-dioleylthiophosphoric acid
Octylamine salt of O,S-dioleyldithiophosphoric acid
Octylamine salt of S,S-dioleyldithiophosphoric acid
Octylamine salt of O-monooleyldithiophosphoric acid
Octylamine salt of S-monooleyldithiophosphoric acid
Octylamine salt of S-monooleyltrithiophosphoric acid
Octylamine salt of S,S-dioleyltrithiophosphoric acid
Octylamine salt of O-monooleylthionophosphoric acid
Octylamine salt of O,O-dioleylthionophosphoric acid
Octylamine salt of S-monooleylthiothionophosphoric acid
Octylamine salt of O-monooleylthiothionophosphoric acid
Octylamine salt of O,S-dioleylthiothionophosphoric acid
Octylamine salt of O,O-dioleylthiothionophosphoric acid
Octylamine salt of O,S-dioleyldithiothionophosphoric acid
Octylamine salt of S,S-dioleyldithiothionophosphoric acid
Octylamine salt of O-monooleyldithiothionophosphoric acid
Octylamine salt of S-ionooleyldithiothionophosphoric acid
Octylamine salt of S-monooleyltrithiothionosphoric acid
Octylamine salt of S,S-dioleyltrithiothionophosphoric acid
Octylamine salt of O-monobenzylphosphoric acid
Octylamine salt of O,O-dibenzylphosphoric acid
Octylamine salt of S-monomethylcyclohexylthiophosphoric acid
Octylamine salt of O-monomethylcyclohexylthiophosphoric acid
Octylamine salt of O,S-dibenzylthiophosphoric acid
Octylamine salt of O,O-dimethylcyclohexylthiophosphoric acid
Octylamine salt of O,S-dibenzyldithiophosphoric acid
Octylamine salt of S,S-dibenzyldithiophosphoric acid
Octylamine salt of O-monomethylcyclohexyldithiophosphoric acid
Octylamine salt of S-monobenzyldithiophosphoric acid
Octylamine salt of S-monomethylcyclohexyltrithiophosphoric acid
Octylamine salt of S,S-dibenzyltrithiophosphoric acid
Octylamine salt of O-monomethylcyclonexylthionophosphoric acid
Octylamine salt of O,O-dimethylcyclohexylthionophosphoric acid
Octylamine salt of S-monobenzylthiothionophosphoric acid
Octylamine salt of O-monobenzylthiothionophosphoric acid
Octylamine salt of O,S-dimethylcyclohexylthiothionophosphoric acid
Octylamine salt of O,O-dimethylcyclohexylthiothionophosphoric acid
Octylamine salt of O,S-dibenzyldithiothionophosphoric acid
Octylamine salt of S,S-dibenzyldithiothionophosphoric acid
Octylamine salt of O-monomethylcyclohexyldithiothionophosphoric acid
Octylamine salt of S-monomethylcyclohexyldithiothionophosphoric acid
Octylamine salt of S-monomethylcyclohexyltrithiothionosphoric acid
Octylamine salt of S,S-dibenzyltrithiothionophosphoric acid
Octylamine salt of O-monoxylylphosphoric acid
Octylamine salt of O,O-ditolylphosphoric acid
Octylamine salt of S-monotolylthiophosphoric acid
Octylamine salt of O-monoxylylthiophosphoric acid
Octylamine salt of O,S-ditolylthiophosphoric acid
Octylamine salt of O,O-dixylylthiophosphoric acid
Octylamine salt of O,S-dixylyldithiophosphoric acid
Octylamine salt of S,S-ditolyldithiophosphoric acid
Octylamine salt of O-monoxylyldithiophosphoric acid
Octylamine salt of S-monotolyldithiophosphoric acid
Octylamine salt of S-monoxylyltrithiophosphoric acid
Octylamine salt of S,S-dixylyltrithiophosphoric acid
Octylamine salt of O-monotolylthionophosphoric acid
Octylamine salt of O,O-dixylylthionophosphoric acid
Octylamine salt of S-monoxylylthiothionophosphoric acid
Octylamine salt of O-monotolylthiothionophosphoric acid
Octylamine salt of O,S-dixylylthiothionophosphoric acid
Octylamine salt of O,O-ditolylthiothionophosphoric acid
Octylamine salt of O,S-dixylyldithiothionophosphoric acid
Octylamine salt of S,S-ditolyldithiothionophosphoric acid
Octylamine salt of O-monoxylyldithiothionophosphoric acid
Octylamine salt of S-monotolyldithiothionophosphoric acid
Octylamine salt of S-monotolyltrithiothionosphoric acid
Octylamine salt of S,S-ditolyltrithiothionophosphoric acid
Octylamine salt of O-isopropyl-O-octadecylphosphoric acid
Octylamine salt of O-nonyl-S-butylthiophosphoric acid
Octylamine salt of O-undecyl-O-methylthiophosphoric acid
Octylamine salt of O-cyclohexyl-S-decyldithiophosphoric acid
Octylamine salt of S-phenyl-S-tetradecyldithiophosphoric acid
Octylamine salt of S-pentadecyl-S-cyclohexenyltrithiophosphoric acid
Octylamine salt of O-ethyl-O-(p-tert-amylphenyl) thionophosphoric acid
Octylamine salt of O-benzyl-S-isononylthiothionophosphoric acid
Octylamine salt of O-cyclopentyl-O-heptadecylthiothionophosphoric acid
Octylamine salt of O-oleyl-S-butyldithiothionophosphoric acid
Octylamine salt of S-2-ethylhexyl-S-isooctyldithiothionophoshoric acid
Octylamine salt of S-allyl-S-tridecyltrithiothionophosphoric acid.

In addition to the octylamine salts or adducts given above for purposes of illustration, use can be made of the corresponding nonylamine, decylamine, undecylamine, dodecylamine, tridecyl-amine, tetradecylamine, pentadecylamine, hexadecylamine, heptadecylamine, octadecylamine, cyclohexylamine, phenylamine, mesitylamine, oleylamine, cocoamine, soyamine, $C_{10-12}$ tertiary alkyl primary amines, and phenethylamine salts or adducts of the above and similar partially esterified acids of pentavalent phosphorus, including mixtures of any such compounds. Secondary hydrocarbyl amines and tertiary hydrocarbyl amines can also be used either alone or in combination with each other or in combination with primary amines. Thus any combination of primary, secondary and/or tertiary amines, whether monoamine or polyamine, can be used in forming the salts or adducts. Use of primary amines is preferred. It is perhaps worth noting that the above referred to partially esterified pentavalent acids of phosphorus have been named, for convenience, by use of the "thio-thiono" system of nomenclature. Such compounds can also be named by use of a "thioic" system of nomenclature. For example, S,S-dihydrocarbyltrithiothionophosphoric acid is also known as S,S-dihydrocarbylphosphorotetrathioic acid, $(RS)_2P(S)(SH)$. Likewise, O,S-dihydrocarbylthiothionophosphoric acid is also known as O,S-dihydrocarbyl-phosphorodithioic acid, $(RO)(RS)P(S)(OH)$; S,S-dihydrocarbyldithiophosphoric acid is also known as S,S-dihydrocarbylphosphorodithioic acid, $(RS)_2P(O)(OH)$; O,O-dihydrocarbylthionophosphoric acid is also known as O,O-dihydrocarbylphosphorothioic acid, $(RO)_2P(S)(OH)$, etc.

Methods for the preparation of such amine salts are well known and reported in the literature. See for example, U.S. Pat. Nos. 2,063,629; 2,224,695; 2,447,288; 2,616,905; 3,984,448; 4,431,552; Pesin et al, *Zhurnal Obshchei Khimii*, Vol. 31, No. 8, pp. 2508–2515 (1961); and International Application Publication No. WO 87/07638.

Component (iii)

Compounds of this type are known in the art. For example European Patent Publication No. 20037, published Dec. 10, 1980, describes their use as friction reducing additives in crank-case lubricating oils and in gasoline and diesel fuel. See also British Patent No. 1,111,837 published May 1, 1968 which suggests their use as ashless dispersants for engine oils and as rust inhi bitors in a variety of lubricating oils, including engine oils. The disclosures of these two documents are incorporated herein by reference. The synthesis method described in the European patent publication is deemed superior to that described in the British patent.

As noted above, component (iii) can be a single compound or a mixture of two or more compounds of the formula

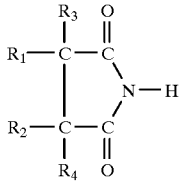

where $R_1$ is an alkyl or alkenyl or polyunsaturated group having an average of 8 to 50, preferably an average of 14 to 30, and most preferably an average of 20 to 24 carbon atoms and each of $R_2$, $R_3$ and $R_4$ is independently, a hydrogen atom or an alkyl or alkenyl group having an average of up to about 4 carbon atoms. Most preferably each of $R_2$, $R_3$ and $R_4$ is a hydrogen atom. In the most preferred compounds $R_1$ is derived from an isomerized 1-olefin and thus is composed predominantly of at least one group (usually a plurality of groups) represented by the formula $R_5R_6CH$— wherein $R_5$ and $R_6$ are independently alkyl or alkenyl groups, which most preferably are linear or substantially linear. The total number of carbon atoms in $R_5$ and $R_6$ is of course one less than the number of carbon atoms in that particular $R_1$.

Illustrative examples of these compounds are given below. In these examples (a) the numerals 3 and 4 designate the position(s) of the substituent(s) on the succinimide ring; (b) the secondary alkenyl substituents represent the predominant alkenyl groups formed when producing the compounds from the corresponding isomerized (predominantly internal) linear olefins by a process such as described in the above-referred to European patent publication; and (c) the secondary alkyl substituents represent the alkyl groups resulting from hydrogenolysis of the secondary alkenyl substituents:

3-octenylsuccinimide
3-octenyl-4-methylsuccinimide
3-octenyl-4,4-dimethylsuccinimide
3-octenyl-4-ethylsuccinimide
3-octenyl-4-ethyl-4-methylsuccinimide
3-octenyl-4-butylsuccinimide
3-octenyl-4-vinylsuccinimide
3-octenyl-4-allylsuccinimide
3-octenyl-4-butenylsuccinimide
3-sec-octenylsuccinimide
3-sec-octenyl-4-isopropylsuccinimide
3-octylsuccinimide
3-octyl-4-methylsuccinimide
3-sec-octylsuccinimide
3-sec-octyl-4-methylsuccinimide
3-sec-octyl-4-ethylsuccinimide
3-sec-octyl-4-propylsuccinimide
3-sec-octyl-4,4-dimethylsuccinimide
3-sec-octyl-4,4-diethylsuccinimide, and the like, and each of the corresponding compounds containing 9 through 50 carbon atoms in the alkyl or alkenyl substituent in the 3-position. Mixtures of two or more of any such compounds can also be used.

An especially preferred succinimide for use as component (iii) is predominantly a mixture of $C_{20}$, $C_{22}$ and $C_{24}$ sec-alkenyl succinimides made from an isomerized 1-olefin mixture containing (wt %):

$C_{18}$ max. 3
$C_{20}$ 45–55
$C_{22}$ 31–47
$C_{24}$ 4–15
$C_{26}$ max. 1

Component (iv)

As noted above, one preferred embodiment of this invention involves the additional presence in the compositions of one or more amine salts of one or more carboxylic acids, especially the amine salts of (a) one or more long chain monocarboxylic acids, or (b) one or more long chain polycarboxylic acids, or (c) a combination of at least one acid of (a) and at least one acid of (b). Generally speaking, these acids contain from about 8 to about 50 carbon atoms in the molecule and thus the salts are oil-soluble. A variety of amines can be used in forming such salts, including primary, secondary and tertiary amines, and the amines can be monoamines, or polyamines. Further, the amines may be cyclic or acyclic aliphatic amines, aromatic amines, heterocyclic amines, or amines containing various mixtures of acyclic and cyclic groups.

Preferred amine salts include the alkyl amine salts of alkanoic acids (Per A) and the alkyl amine (Per A) salts of alkanedioic acids.

The amine salts are formed by classical chemical reactions, namely, the reaction of an amine or mixture of amines, with the appropriate acid or mixture of acids. Accordingly, further discussion concerning methods for the preparation of such materials would be redundant.

Among the amine salts of long-chain acids that may be used are the following: lauryl ammonium laurate (i.e. the lauryl amine salt of lauric acid), stearyl ammonium laurate, cyclohexyl ammonium laurate, octyl ammonium laurate, pyridine laurate, aniline laurate, lauryl ammonium stearate, stearyl ammonium stearate, cyclohexyl ammonium stearate, octylammonium stearate, pyridine stearate, aniline stearate, lauryl ammonium octanoate, stearyl ammonium octanoate, cyclohexyl ammonium octanoate, octyl ammonium octanoate, pyridine octanoate, aniline octanoate, nonyl ammonium laurate, nonyl ammonium stearate, nonyl ammonium octanoate, lauryl ammonium nonanoate, stearyl ammonium nonanoate, cyclohexyl ammonium nonanoate, octyl ammonium nonanoate, pyridine nonanoate, aniline nonanoate, nonyl ammonium nonanoate, lauryl amnonium decanoate, stearyl ammonium decanoate, cyclohexyl ammonium decanoate, octyl ammonium deconoate, pyridine decanoate, aniline decanoate, decyl ammonium laurate, decyl ammonium stearate, decyl ammonium octanoate, decyl ammonium nonanoate, decyl ammonium decanoate, bis octyl amine salt of suberic acid, bis cyclohexyl amine salt of suberic acid, bis lauryl amine salt of suberic acid, bis stearyl amine salt of suberic acid, bis octyl amine salt of sebacic acid, bis cyclohexyl amine salt of sebacic acid, bis lauryl amine salt of sebacic acid, bis stearyl amine salt of sebacic acid, the tert-dodecyl and tert-tetradecyl primary amine salts of octanoic acid, the tert-decyl and tert-dodecyl primary amine salts of octanoic acid, the tert-dodecyl and tert-tetradecyl primary amine salts of lauric acid, the tert-decyl and tert-dodecyl primary amine salts of lauric acid, the tert-dodecyl and tert-tetradecyl primary amine salts of stearic acid, the tert-decyl and tert-dodecyl primary amine salts of stearic acid, the hexyl amine salt of $C_{24}$-dicarboxylic acid, the octyl amine salt of $C_{28}$-dicarboxylic acid, the octyl amine salt of $C_{30}$-dicarboxylic acid, the decyl amine salt of $C_{30}$-dicarboxylic acid, the octyl amine salt of $C_{32}$-dicarboxylic acid, the bis lauryldimethyl amine salt of traumatic acid, diethyl ammonium laurate, dioctyl ammonium laurate, dicyclohexyl ammonium laurate, diethyl ammonium octanoate, dioctyl ammonium octanoate, dicyclohexyl ammonium octanoate, diethyl ammonium stearate, dioctyl ammonium stearate, diethyl ammonium stearate, dibutyl ammonium stearate, dicyclopentyl ammonium stearate, dipropyl ammonium benzoate, didecyl ammonium benzoate, dimethylcyclohexyl ammonium benzoate, triethyl ammonium laurate, triethyl ammonium octanoate, triethyl ammonium stearate, triethyl ammonium benzoate, trioctyl ammonium laurate, trioctyl ammonium octanoate, trioctyl ammonium stearate, trioctyl ammonium benzoate, and the like. It will be understood of course that the amine salt of the monocarboxylic and/or polycarboxylic acid used should be sufficiently soluble in the base oil used as to provide homogeneous solution at the concentration employed.

Among the preferred amine salts for use in practice of this invention are the primary amine salts of long chain monocarboxylic acids in which the amine thereof is a monoalkyl monoamine, $RNH_2$; the secondary amine salts of long chain monocarboxylic acids in which the amine thereof is a dialkyl monoamine, $R_2NH$; the tertiary amine salts of long chain monocarboxylic acids in which the amine thereof is a trialkyl monoamine, $R_3N$; the bis primary amine salts of long chain dicarboxylic acids in which the amine thereof is a monoalkyl monoamine, $RNH_2$; the bis secondary amine salts of long chain dicarboxylic acids in which the amine thereof is a dialkyl monoamine, $R_2NH$; the bis tertiary amine salts of long chain dicarboxylic acids in which the amine thereof is a trialkyl monoamine, $R_3N$; and mixtures thereof. In the foregoing formulae, R is an alkyl group which contains up to about 30 or more carbon atoms, and preferably from about 6 to about 24 carbon atoms.

Component (v)

Another type of component which is preferably utilized in the compositions of this invention is comprised of the nitrogen-containing ashless dispersants. Thus, in accordance with a preferred embodiment of this invention, the composition additionally contains at least one nitrogen-containing ashless dispersant such as a hydrocarbyl substituted succinimide, a hydrocarbyl substituted succinic acid, a hydrocarbyl substituted succinamide, a hydrocarbyl substituted succinic ester/amide, a long-chain hydrocarbyl amine, a Mannich-type ashless dispersant, or the like. Such materials are well known in the art. Thus for a description of typical hydrocarbyl succinimides, which include post-treated hydrocarbyl succinimides, reference may be had, for example, to the following U.S. Pat. Nos: 3,018,247; 3,018,250; 3,018,291; 3,087,936; 3,172,892; 3,184,411; 3,184,474; 3,185,645; 3,185,704; 3,194,812; 3,194,814; 3,200,107; 3,202,678; 3,215,707; 3,219,666; 3,231,587; 3,254,025; 3,256,185; 3,272,746; 3,272,746; 3,278,550; 3,280,034; 3,281,428; 3,282,955; 3,284,410; 3,287,271; 3,311,558; 3,312,619; 3,331,776; 3,338,832; 3,341,542; 3,344,069; 3,346,354; 3,347,645; 3,359,204; 3,361,673; 3,366,569; 3,367,943; 3,369,021; 3,373,111; 3,381,022; 3,390,086; 3,399,141; 3,401,118; 3,458,530; 3,470,098; 3,502,677; 3,511,780; 3,513,093; 3,541,012; 3,551,466; 3,558,473; 3,573,205; 3,576,743; 3,578,422; 3,652,616; 3,658,494; 3,658,495; 3,718,663; 3,749,695; 3,865,740; 3,865,813; 3,912,764; 3,954,639; 4,110,349; 4,234,435 4,338,205; 4,374,033; 4,401,581; 4,410,437; 4,428,849; 4,548,724; 4,554,086; 4,608,185; 4,612,132; 4,614,603; 4,615,826; 4,645,515; 4,710,201; 4,713,191; 4,746,446; 4,747,963; 4,747,964; 4,747,965; and 4,857,214. See also British 1,085,903 and British 1,162,436.

Mixed ester-amides of hydrocarbyl substituted succinic acids using alkanols, amines and/or aminoalkanols are described, for example, in U.S. Pat. Nos. 3,576,743 and 4,234,435.

Another type of ashless dispersant which can be used in the practice of this invention comprises the hydrocarbyl substituted succinic acid esters and the hydrocarbyl substituted succinic acid salts. Such well-known additives and their preparation are described in the literature such as for example in U.S. Pat. No. 4,234,435 and references cited therein.

Amine dispersants and methods for their production from high molecular weight aliphatic or alicyclic halides and amines are described for example, in U.S. Pat. Nos. 3,275,554; 3,438,757; 3,454,555; and 3,565,804.

For a description of Mannich-type ashless dispersants which can be used in the practice of this invention, see for example the following U.S. Pat. Nos.: 3,368,972; 3,413,347; 3,442,808; 3,448,047; 3,539,633; 3,591,598; 3,600,372;

3,634,515; 3,697,574; 3,703,536; 3,704,308; 3,725,480; 3,726,882; 3,736,357; 3,751,365; 3,756,953; 3,793,202; 3,798,165; 3,798,247; and 3,803,039.

The disclosures of all of the above cited U.S. patents are incorporated herein by reference as regards basic nitrogen-containing dispersants, their production, and their use.

The preferred ashless dispersants are hydrocarbyl succinimides in which the hydrocarbyl substituent is a hydrogenated or unhydrogenated polyolefin group and preferably a polyisobutene group having a number average molecular weight (as measured by gel permeation chromatography) of from 250 to 10,000, and more preferably from 500 to 5,000, and most preferably from 750 to 2,500. The ashless dispersant is most preferably an alkenyl succinimide such as is available commercially from Ethyl Petroleum Additives, Inc. and Ethyl Petroleum Additives, Ltd. as HITEC® 644 and HITEC® 646 additives.

The ashless dispersants which can be used in the compositions of this invention also include ashless dispersants of the types described above which have been subjected to post-treatment with a suitable post-treating reagent. In preparing a post-treated ashless dispersant, any of a wide variety of post-treating agents can be used. Such post-treating agents include, for example, boron oxide, boron oxide hydrate, boron halides, boron acids, esters of boron acids, carbon disulphide, hydrogen sulphide, sulfur, sulfur chloride, alkenyl cyanides, carboxylic acid acylating agents, aldehyde, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulphides, hydrocarbyl thiocyanates, hydrocarbyl isocyanates, hydrocarbyl isothiocyanates, epoxides, episulphides, formaldehyde or formaldehyde producing compounds plus phenols, sulfur plus phenols, and many others.

Preferred post-treating agents and procedures involve use of phosphorus-containing post-treating agents or boron-containing post-treating agents.

The phosphorus-containing post-treating agents comprise organic compounds capable of reacting with the dispersant in order to introduce phosphorus or phosphorus-containing moieties into the dispersant. Thus use can be made of such organic phosphorus compounds as monohydrocarbyl phosphites, dihydrocarbyl phosphites, trihydrocarbyl phosphites, monohydrocarbyl phosphates, dihydrocarbyl phosphates, trihydrocarbyl phosphates, the hydrocarbyl pyrophosphates, and their partial or total sulfur analogs wherein the hydrocarbyl group(s) contain up to about 30 carbon atoms each.

The boron-containing post-treating agents comprise both inorganic and organic compounds capable of reacting with the dispersant in order to introduce boron or boron-containing moieties into the dispersant. Accordingly, use can be made of such inorganic boron compounds as the boron acids, and the boron oxides, including their hydrates. Typical organic boron compounds include esters of boron acids, such as the orthoborate jesters, metaborate esters, biborate esters, pyroboric acid esters, and the like.

It is particularly preferred to utilize an ashless dispersant, most especially a hydrocarbyl-substituted succinimide dispersant, that contains only carbon, hydrogen, nitrogen, and optionally oxygen and/or sulfur atoms in its chemical structure. Such compounds produce little or no adverse deposits on critical mechanical parts during actual service.

Component (vi)

As noted above, a preferred embodiment of this invention involves the additional presence in the system of one or more oil-soluble fully-esterified hydrocarbyl esters of a phosphoric acid or one or more oil-soluble fully-esterified hydrocarbyl esters of a phosphorothioic acid, or a combination of one or more oil-soluble fully-esterified hydrocarbyl esters of a phosphoric acid and one or more oil-soluble fully-esterified hydrocarbyl esters of a phosphorothioic acid. Such compounds may be represented by the general formula:

(IV)

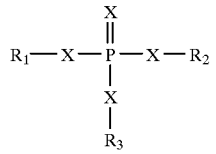

wherein each of $R_1$, $R_2$, and $R_3$ is independently a hydrocarbyl group and each X is independently an oxygen atom or a sulfur atom. Thus when the compound has the formula:

(V)

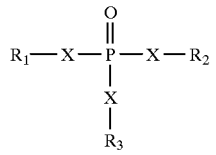

it is a fully-esterified hydrocarbyl ester of a phosphoric acid. On the other hand, when the compound has the formula:

(VI)

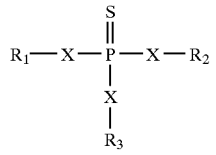

it is a fully-esterified hydrocarbyl ester of a phosphorothioic acid. In the foregoing formulas, the hydrocarbyl groups $R_1$, $R_2$, and $R_3$ can be any hydrocarbyl group, such as alkyl, cycloalkyl, aryl, cycloalkylalkyl, aralkyl, alkenyl, cycloalkenyl, etc. Such hydrocarbyl groups may each contain up to 50 or more carbon atoms, although ordinarily they will contain up to about 24 carbon atoms. The hydrocarbyl groups may be substituted by inert substituents in the sense that the substituents do not interfere with the functioning of the other components nor destroy the effectiveness of the compositions of this invention. For example, the hydrocarbyl groups of the phosphorus esters may include ether oxygen atoms, thioether sulfur atoms, nitrogen atoms, ester functionality, hydroxyl groups, sulfhydryl groups, and like substituents. Thus, the fully-esterified phosphate and phosphoricthioate esters used in the practice of this invention may include alkoxyalkyl, poly(alkoxy)alkyl, alkylthio-alkyl, aryloxyalkyl, dialkylaminoalkyl, diarylaminoalkyl, hydroxyalkyl, and like inert (innocuous) substituents.

A preferred group of compounds for use as component (vi) are the O,O-dihydrocarbyl-S-hydrocarbyl phosphorothiothionates of the general formula:

(VII)

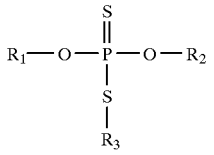

wherein each of $R_1$, $R_2$, and $R_3$ is independently a hydrocarbyl group, especially where $R_3$ is an alicyclic hydrocarbyl group. Particularly preferred are the O,O-dialkyl-S-hydrocarbyl phosphorothiothionates wherein $R_3$ is an alicyclic group and $R_1$ and $R_2$ are alkyl groups each having up to about 18 carbon atoms and most preferably up to about 12 carbon atoms.

Various phosphoric and phosphorothioic esters of the type depicted in formulas IV, V, VI, and VII above and methods for their preparation have been reported in the literature. See for example, U.S. Pat. Nos. 2,528,732, 2,561,773, 2,665,295, 2,767,206, 2,802,856, 3,023,209, and *J. Org. Chem.*, 1963, 28, 1262–8.

Exemplary compounds suitable for use as component (vi) include such fully-esterified phosphates and phosphorothioates as fusel oil phosphate, tricresyl phosphate, dibutyl phenyl phosphate, tri-2-ethylhexyl phosphate, triisodecyl phosphate, trilauryl phosphate, trioctylphosphorothiothionate, tridecylphosphorodithiothionate, trilaurylphosphorotrithiothionate, diethyl bicyclo(2.2.1)-hepten-2-yl phosphate, O,O-diethyl S-bicyclo(2.2.1)-5-hepten-2-yl phosphorothiothionate, diethyl 7,7-dimethyl-bicyclo(2.2.1)-5-hepten-2-yl phosphate, the product formed by reaction of dithiophosphoric acid-O,O-dimethyl ester with cis-endomethylene-tetrahydrophthalic acid dimethyl ester, the product formed by reaction of dithiophosphoric acid-O,O-dimethyl ester with cis-endomethylene-tetrahydrophthalic acid dibutyl ester, the product formed by reaction of dithiophosphoric acid-O,O-dibutyl ester with cis-endomethylene-tetrahydrophthalic acid dilauryl ester, the product formed by reaction of dithiophosphoric acid-O,O-dimethyl ester with 2,5-endomethylene-1-methyltetrahydrobenzoic acid butyl ester, the product formed by reaction of dithiophosphoric acid-O,O-dimethyl ester with 2,5-endomethylene-1-methyl-tetrahydrobenzoic acid decyl ester, the product formed by reaction of dithiophosphoric acid-O,O-dimethyi ester with 2,5-endomethylene-6-methyl-tetrahydrobenzoic acid ethyl ester, the product formed by reaction of dithiophosphoric acid-O,O-diethyl ester with 2,5-endomethylene-tetrahydrobenzyl alcohol, the product formed by reaction of dithiophosphoric acid-O,O-dimethyl ester with the Diels-Alder adduct of cyclopentadiene and allyl alcohol (2 mols:1 mol), the product formed by reaction of dithiophosphoric acid-O,O-dimethyl ester with 2,5-endomethylene-tetrahydrophenyl acetate, the product formed by reaction of dithiophosphoric acid-O,O-dibutyl ester with the Diels-Alder adduct of cyclopentadiene and vinyl acetate (2 mols:1 mol), the product formed by reaction of dithiophosphoric acid-O,O-dimethyl ester with the bis-cyclopentadiene adduct of p-benzoquinone, the product formed by reaction of dithiophosphoric acid-O,O-dimethyl ester with the azodicarboxylic acid diethyl ester, the product formed by reaction of dithiophosphoric acid-O,O-dimethyl ester with dicyclopentadiene, the product formed by reaction of dithiophosphoric acid-O,O-dibutyl ester with dicyclopentadiene, the product formed by reaction of dithiophosphoric acid-O,O-dioctyl ester with dicyclopentadiene, the product formed by reaction of dithiophosphoric acid-O,O-dilauryl ester with dicyclopentadiene, the product formed by reaction of dithiophosphoric acid-O,O-di-2-ethylhexyl ester with wax olefin, the product formed by reaction of dithiophosphoric acid-O,O-di2-ethylhexyl ester with oleyl alcohol, the product formed by reaction of dithiophosphoric acid-O,O-di-2-ethylhexyl ester with linseed oil, the product formed by reaction of dithiophosphoric acid-O,O-diamyl ester with alpha pinene, the product formed by reaction of dithiophosphoric acid-O,O-diphenyl ester with alpha pinene, the product formed by reaction of dithiophosphoric acid-O,O-diamyl ester with allo-ocimene, the product formed by reaction of dithiophosphoric acid-O,O-dioctyl ester with dipentene, and the like.

Diluents

The additive concentrates of this invention preferably contain a suitable diluent, most preferably an oleaginous diluent of suitable viscosity. Such diluent can be derived from natural or synthetic sources. Among the mineral (hydrocarbonaceous) oils are paraffin base, naphthenic base, asphaltic base and mixed base oils. Typical synthetic base oils include polyolefin oils (especially hydrogenated α-olefin oligomers), alkylated aromatics, polyalkylene oxides, aromatic ethers, and carboxylate esters (especially diester oils), among others. Blends of natural and synthetic oils can also be used. The preferred diluents are the light hydrocarbon base oils, both natural and (Per A) synthetic. Generally the diluent oil will have a viscosity in the range of 13 to 35 centistokes at 40° C., and preferably in the range of 18.5 to 21.5 centistokes at 40° C. A 100 neutral mineral oil with a viscosity of about 19 centistokes at 40° C. with a specific gravity (ASTM D1298) in the range of 0.855 or 0.893 (most preferably about 0.879) at 15.6° C. (60° F.) and an ASTM color (D1500) of 2 maximum is particularly preferred for this use.

Gear Oil Base Stocks

The gear oils in which the compositions of this invention are employed can be based on natural or synthetic oils, or blends thereof, provided the lubricant has a suitable viscosity for use in gear oil applications. Thus the base oils will normally have a viscosity in the range of SAE 50 to SAE 250, and more usually will range from (Per A) SAE 70W to SAE 140. Suitable automotive gear oils also include cross-grades such as 75W-140, 80W-90, 85W-140, 85W-90, and the like. The base oils for such use are generally mineral oil base stocks such as for example conventional and solvent-refined paraffinic neutrals and bright stocks, hydrotreated paraffinic neutrals and bright stocks, naphthenic oils, cylinder oils, etc., including straight run and blended oils. Synthetic base stocks can also be used in the practice of this invention, such as for example poly-α-olefin oils (PAO), alkylated aromatics, polybutenes, diesters, polyol esters, polyglycols, polyphenyl ethers, etc., and blends thereof. Typical of such oils are blends of poly-alpha-olefins with synthetic diesters in weight proportions (PAO:ester) ranging from about 95:5 to about 50:50, typically about 75:25.

Proportions

In forming the gear oils of this invention, the lubricant cant base stocks will usually contain components (i), (ii) and (iii), and optionally but preferably one or m components (iv), (v) and (vi), in the following concentrations (weight percentages of active ingredients):

| Component | Preferred Range | More Preferred Range | Most Preferred Range |
|---|---|---|---|
| (i) | 1–5 | 1.5–4.5 | 2–4 |
| (ii) | 0.1–3 | 0.2–2 | 0.3–1 |
| (iii) | 0.05–4 | 0.1–2 | 0.2–1 |
| (iv) | 0.001–2 | 0.01–1 | 0.05–0.5 |
| (v) | 0.1–4 | 0.3–2 | 0.5–1 |
| (vi) | 0.2–5 | 0.5–3 | 0.75–1.5 |

The proportions of components (i), (ii) and (iii) and preferably also one or more of components (iv), and (vi) in the additive concentrates of this invention are as follows:

| Component | Preferred Range | More Preferred Range | Most Preferred Range |
|---|---|---|---|
| (i) | 20–80 | 30–70 | 35–65 |
| (ii) | 1–15 | 3–12 | 5–10 |
| (iii) | 1–20 | 3–15 | 5–10 |
| (iv) | 0–12 | 0.4–5 | 0.5–2 |
| (v) | 0–50 | 3–12 | 5–10 |
| (vi) | 0–30 | 5–25 | 10–25 |

Other components, such as described below, can also be included in such additive concentrates. in such additive concentrates.

Other Components

The gear oils and gear oil additive concentrates of this invention can contain various other conventional additives to partake of their attendant functions. These include, for example, the following materials:

Defoamers—Illustrative materials of this type include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate, and the like. Defoamers are generally employed at concentrations of up to about 1% in the additive concentrate.

Demulsifiers—Typical additives which may be employed as demulsifiers in gear oils include alkyl benzene sulfonates, olyethylene oxides, polypropylene oxides, esters of oil soluble acids, and the like. Such additives are generally employed at concentration of up to about 3% in the additive concentrate.

Sulfur scavengers—This class of additives includes such materials as thiadiazoles, triazoles, and in general, compounds containing moieties reactive to free sulfur under elevated temperature conditions. See for example U.S. Pat. Nos. 3,663,561 and 4,097,387. Concentrations of up to about 3% in the concentrate are typical.

Antioxidants—Ordinarily, antioxidants that may be employed in gear oil formulations include phenolic compounds, amines, phosphites, and the like. Amounts of up to about 5% in the concentrate are generally sufficient.

Other commonly used additives or components include anti-rust agents or rust inhibitors, corrosion inhibitors, detergents, dyes, metal deactivators, pour point depressants, and diluents.

As noted above, the preferred compositions of this inventional are essentially devoid of metal-containing components. For the purposes of this invention, boron is not considered to be a metal and thus the compositions of this invention may contain boron-containing components.

Examples 1–14 illustrate typical additive concentrates of this invention. In these examples, "pbw" represents parts by weight of the specific ingredient, which in the case of the succinimides, is the amount of active ingredient.

EXAMPLE 1

| | |
|---|---|
| Sulfurized isobutylene | 460 pbw |
| Oleyl amine salts of o,o-dibutyl phosphorothioate | 81 pbw |
| $C_{20}$, $C_{22}$, $C_{24}$ Alkenylsuccinimide* | 100 pbw |
| 100 Neutral Oil (19 centistokes at 40° C.) | 290 pbw |

*Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins

EXAMPLE 2

| | |
|---|---|
| Sulfurized isobutylene | 550 pbw |
| Octyl amine salts of o,o-di-2-ethylhexyl phosphorodithioate | 100 pbw |
| $C_{18}$ Alkenylsuccinimide* | 120 pbw |
| 100 Neutral Oil (19 centistokes at 40° C.) | 280 pbw |

*Formed from isomerized 1-octadecene

EXAMPLE 3

| | |
|---|---|
| Di-tert-butyl trisulfide | 500 pbw |
| Lauryl amine salt of 2-ethylhexyl acid phosphate | 90 pbw |
| Isomerized eicosenyl succinimide | 110 pbw |
| 100 Neutral Oil (19 centistokes at 40° C.) | 300 pbw |

EXAMPLE 4

| | |
|---|---|
| Sulfurized isobutylene | 600 pbw |
| $C_{10}$ and $C_{12}$ dialkyl amine salts of octyl phosphorotetrathioic acid | 100 pbw |
| Isomerized $C_{16}$, $C_{18}$, $C_{20}$ alkenylsuccinimide* | 125 pbw |
| 100 Neutral Oil (19 centistokes at 40° C.) | 270 pbw |

*Formed from an alkene mixture made by isomerizing a mixture containing 45% 1-hexadecene, 35% 1-octadecene, and 20% 1-eicosene.

EXAMPLE 5

| | |
|---|---|
| Sulfurized isobutylene | 460 pbw |
| Oleyl amine salt of o,o-di-n-butyl phosphorothioate | 80 pbw |
| Tricontenyl succinimide | 100 pbw |
| Polyisobutenyl succinimide of tetraethylene pentamine* | 100 pbw |
| 100 Neutral Oil (19 centistokes at 40° C.) | 310 pbw |

*Formed from polyisobutene having a number average molecular weight of 1300.

EXAMPLE 6

| | |
|---|---|
| Sulfurized isobutylene | 400 pbw |
| Oleyl amine salt of o,o-di-hexyl phosphorothioate | 100 pbw |
| Polyisobutenylsuccinimide* | 100 pbw |
| Lauryl amine salt of stearic acid | 25 pbw |
| 100 Neutral Oil (19 centistokes at 40° C.) | 330 pbw |

*Made from ammonia and polyisobutenylsuccinic anhydride formed from a polyisobutene having a number average molecular weight of 560.

EXAMPLE 7

| | |
|---|---|
| Di-tert-nonyl trisulfide | 600 pbw |
| Palmitic amine salt of o,o-di-2-ethylhexyl phosphoric acid | 75 pbw |
| Polypropenylsuccinimide* | 120 pbw |
| Trilauryl phosphorothioate | 235 pbw |
| 100 Neutral Oil (19 centistokes at 40° C.) | 300 pbw |

*Made from ammonia and polypropenylsuccinic anhydride formed from a polypropylene having a number average molecular weight of 500.

EXAMPLE 8

| | |
|---|---|
| Sulfurized isobutylene | 600 pbw |
| Decyl amine salts of o,o-dihexyl phosphorodithioate | 150 pbw |
| $C_{20}$, $C_{22}$, $C_{24}$ Alkenylsuccinimide* | 100 pbw |
| Polyisobutenyl succinimide of tetraethylene pentamine | 75 pbw |
| Linolenyl amine salt of lauric acid | 25 pbw |
| 100 Neutral Oil (19 centistokes at 40° C.) | 290 pbw |

*Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins.

EXAMPLE 9

| | |
|---|---|
| Sulfurized isobutylene | 460 pbw |
| Oleyl amine salts of o,o-di-2-ethylhexyl phosphorothioate | 100 pbw |
| $C_{18}$ Alkenylsuccinimide* | 120 pbw |
| Oleyl amine salt of octanoic acid | 30 pbw |
| Boronated polyisobutenyl succinimide of tetraethylene pentamine** | 165 pbw |
| 100 Neutral Oil (19 centistokes at 40° C.) | 280 pbw |

*Formed from isomerized 1-octadecene
**Formed from polyisobutene having a number average molecular weight of 1300 and boronated by treatment with boric acid to a level of approximately 1.3% boron.

EXAMPLE 10

| | |
|---|---|
| Sulfurized isobutylene | 400 pbw |
| Linoleyl amine salts of o,o-dihexyl phosphorodithioate | 100 pbw |
| $C_{20}$, $C_{22}$, $C_{24}$ Alkenylsuccinimide* | 100 pbw |
| Lauryl amine salt of oleic acid | 30 pbw |
| Polyisobutenyl succinimide of triethylene tetramine | 100 pbw |
| 100 Neutral Oil (19 centistokes at 40° .) | 290 pbw |

*Formed from ammonia and alkenyl succinic anhydride produced from a mixture of olefins#made by isomerizing a l-olefin mixture containing 49% $C_{20}$, 42% $C_{22}$, and 8% $C_{24}$ 1-olefins.

EXAMPLE 11

| | |
|---|---|
| Sulfurized isobutylene | 550 pbw |
| Octyl amine salts of o,o-di-2-ethylhexyl phosphorodithioate | 80 pbw |
| $C_{18}$ Alkenylsuccinimide* | 120 pbw |
| Oleyl amine salt of decanoic acid | 30 pbw |
| Polyisobutenyl succinimide tetraethylene pentamine** | 200 pbw |
| 100 Neutral Oil (19 centistokes at 40° C.) | 280 pbw |

*Formed from isomerized 1-octadedene
**Formed from polyisobutene having a number average molecular weight of 1300.

EXAMPLE 12

| | |
|---|---|
| Dibenzyl disulfide | 700 pbw |
| Stearyl amine salt of 2-ethylhexyl acid phosphate | 100 pbw |
| Isomerized eicosenyl succinimide | 110 pbw |
| Trihydrocarbyl phosphorodithioate | 180 pbw |
| Polyisobutenyl succinimide of tetraethylene pentamine* | 100 pbw |
| 100 Neutral Oil (19 centistokes at 40° C.) | 300 pbw |

*Formed from polyisobutene having a number average molecular weight of 1300.

EXAMPLE 13

| | |
|---|---|
| Sulfurized isobutylene | 500 pbw |
| $C_{10}$ and $C_{12}$ dialkyl amine salts of octyl phosphorotetrathioic acid | 150 pbw |
| Isomerized $C_{16}$, $C_{18}$, $C_{20}$ alkenylsuccinimide* | 125 pbw |
| Boronated polyisobutenyl succinimide of tetraethylene pentamine** | 100 pbw |
| Octyl and decyl amine salts of octanoic acid o,o-dialkyl-s-dicyclopentadienyl phosphorodithioate*** | 30 pbw |
| 100 Neutral Oil (19 centistokes at 40° C.) | 270 pbw |

*Formed from an alkene mixture made by isomerizing a mixture containing 45% 1-hexadecene, 35% 1-octadecene, and 20% 1-eicosene.
**Formed from polyisobutene having a number average molecular weight of 1300 and boronated by treatment with boric acid to a level of approximately 1.3% boron.
***Alkyl groups comprise a mixture of isopropyl, isobutyl and 2-ethylhexyl groups.

EXAMPLE 14

| | |
|---|---|
| Sulfurized isobutylene | 460 pbw |
| Oleyl amine salts of o,o-dibutyl phosphorodithioate | 80 pbw |
| $C_{20}$, $C_{22}$, $C_{24}$ Alkenylsuccinimide* | 100 pbw |
| Polyisobutenyl succinimide of tetraethylene pentamine** | 225 pbw |
| o,o-dialkyl-s-dicyclopentadienyl phosphorodithioate*** | 300 pbw |
| Myristyl amine salt of lauric acid | 25 pbw |
| 100 Neutral Oil (19 centistokes at 40° C.) | 290 pbw |

*Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins.
**Formed from polyisobutene having a number average molecular weight of 1300.
***Alkyl groups comprise a mixture of isopropyl, isobutyl and 2-ethylhexyl groups.

Examples 15–32 illustrate gear oil compositions of this invention. The base oils used in these examples are mineral oil base stocks, synthetic base stocks and suitable combinations of mineral oil and synthetic base oils. Such base oils may contain a viscosity index improver if desired. The percentages given in these examples are by weight and are based on the total weight of the base oil plus additives. For example, components totaling 2.15% are present in a gear oil composition containing 97.85% of the base oil. The components identified in these examples are preferably added in the form of an additive concentrate of this invention. They can, however, be blended into the base oil separately or in various sub-combinations.

EXAMPLE 15

Automotive gear oils with SAE straight grades of 75 or lower and automotive gear oils with SAE cross grades having a light viscosity end of 75W or lower are blended to contain the following components:

| | |
|---|---|
| Sulfurized isobutylene | 3.4% |
| Oleyl amine salts of o,o-dibutyl phosphorothioate* | 0.6% |
| $C_{20}$, $C_{22}$, $C_{24}$ Alkenylsuccinimide** | 0.75% |
| | 4.75% |

*Product formed by reacting a mixture of sulfurized isobutylene and oleyl amine with di-n-butyl phosphite.
**Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins.

EXAMPLE 16

Example 15 is repeated except that the base gear oils are of SAE grades heavier than 75 and the total of the components (used in the same relative proportions) is 3.18%.

EXAMPLE 17

Example 15 is repeated except that the oils are designed for industrial oil usage and thus the base oil has a 150 viscosity grade in the range of 68 to 460. In this case the total of the components (used in the same relative proportions) is 1.22%.

EXAMPLE 18

Automotive gear oils with SAE straight grades of 75 or lower and automotive gear oils with SAE cross grades having a light viscosity end of 75W or lower are blended to contain the following components:

| | |
|---|---|
| Di-tert-butyl trisulfide | 3.75% |
| Octyl amine salt of 2-ethylhexyl acid phosphate | 0.7% |
| Isomerized eicosenyl succinimide | 0.83% |
| Lauryl amine salt of the dimer of linoleic acid | 0.2% |
| | 5.48% |

EXAMPLE 19

Example 18 is repeated except that the base gear oils are of SAE grades heavier than 75 and the total of the components (used in the same relative proportions) is 3.65%.

EXAMPLE 20

Example 18 is repeated except that the oils are designed for industrial oil usage and thus the base oil has a ISO viscosity grade in the range of 68 to 460. In this case the total of the components (used in the same relative proportions) is 1.46%.

EXAMPLE 21

Automotive gear oils with SAE straight grades of 75 or lower and automotive gear oils with SAE cross grades having a light viscosity end of 75W or lower are blended to contain the following components:

| | |
|---|---|
| Sulfurized isobutylene | 3.40% |
| Oleyl amine salts of o,o-dibutyl phosphorothioate | 0.60% |
| $C_{20}$, $C_{22}$, $C_{24}$ Alkenylsuccinimide* | 0.75% |

-continued

| | |
|---|---|
| Polyisobutenyl succinimide of tetraethylene pentamine** | 1.20% |
| | 5.95% |

*Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins.
**Formed from polyisobutene having a number average molecular weight of 300.

EXAMPLE 22

Example 21 is repeated except that the base gear oils are of SAE grades heavier than 75 and the total of the components (used in the same relative proportions) is 4.0%.

EXAMPLE 23

Example 21 is repeated except that the oils are designed for industrial oil usage and thus the base oil has a ISO viscosity grade in the range of 68 to 460. In this case the total of the components (used in the same relative proportions) is 1.56%.

EXAMPLE 24

Automotive gear oils with SAE straight grades of 75 or lower and automotive gear oils with SAE cross grades having a light viscosity end of 75W or lower are blended to contain the following components:

| | |
|---|---|
| Sulfurized lard oil | 4.95% |
| Dodecyl amine salt of diaryl phosphorotetrathioate | 0.75% |
| Polyisobutenyl succinimide* | 0.75% |
| Tricresyl phosphate | 1.50% |
| | 7.95% |

*Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins.

EXAMPLE 25

Example 24 is repeated except that the base gear oils are of SAE grades heavier than 75 and the total of the components (used in the same relative proportions) is 5.3%.

EXAMPLE 26

Example 24 is repeated except that the oils are designed for industrial oil usage and thus the base oil has a ISO viscosity grade in the range of 68 to 460. In this case the total of the components (used in the same relative proportions) is 2.1%.

EXAMPLE 27

Automotive gear oils with SAE straight grades of 75 or lower and automotive gear oils with SAE cross grades having a light viscosity end of 75W or lower are blended to contain the following components:

| | |
|---|---|
| Sulfurized isobutylene | 3.41% |
| Oleyl amine salts of dibutyl phosphorothioate | 0.60% |
| $C_{20}$, $C_{22}$, $C_{24}$ Alkenylsuccinimide* | 0.75% |
| Oleylamine salts of a 50-50 mixture of octanoic acid and dimerized linoleic acid | 0.24% |
| Polyisobutenylsuccinimide of tetraethylene pentamine** | 1.20% |

-continued

| | |
|---|---|
| o,o-dialkyldicyclopentadienyl phosphorodithioate | 1.62% |
| | 7.82% |

*Formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins.
**Formed from polyisobutene having a number average molecular weight of 1300.

EXAMPLE 28

Example 27 is repeated except that the base gear oils are of SAE grades heavier than 75 and the total of the components (used in the same relative proportions) is 5.24%.

EXAMPLE 29

Example 27 is repeated except that the oils are designed for industrial oil usage and thus the base oil has a ISO viscosity grade in the range of 68 to 460. In this case the total of the components (used in the same relative proportions) is 2.06%.

EXAMPLES 30–32

Examples 27–29 are repeated except that the polyisobutenylsuccinimide is boronated to a boron content of approximately 1.3%.

The effectiveness of the compositions of this invention in alleviating the problem of noise and chatter in limited slip differentials was illustrated by tests conducted in accordance with the GM limited slip axle chatter test (R-4A1-4). In the version of the test employed, the vehicle used was a 1986 Buick Grand National having a 3.8 liter turbo-charged V-6 engine with single port fuel injection. The vehicle was equipped with an automatic transmission, power steering and brakes, and a clutch pack "plate" limited slip differential.

Prior to each test the rear axle was dissembled to allow replacement of the limited slip clutch packs, plates and springs. The entire assembly was washed with Stoddard solvent and air-dried to remove traces of any previous lubricant. The axle was assembled and lubricated with the test lubricant and a thermocouple was installed into the axle assembly to allow recording of lubricant temperature. The unit was bias checked, then run-in with equal size rear tires at 40 to 50 mph for fifty miles.

After the run-in, tires of different diameters were installed on the rear of the vehicle to obtain the specified differential rate between right and left wheel. The larger diameter tire being installed on the right rear position. At the recommendation of General Motors, E78×15 and L78×15 tires were used, resulting in approximately eight to nine revolutions per mile differential rate.

The test consisted of mileage accumulation at 55 to 60 mph with rear axle lubricant temperature between 280° F. and 300° F. The axle was insulated and the speed was varied slightly to maintain temperature within limits. Chatter checks were performed at approximately 100-mile intervals and torque bias checks were performed each thousand miles and at test completion.

The torque bias check consisted of placing one rear wheel on a low friction surface and a 2×4 block tightly in front of a front wheel. The vehicle was slowly accelerated to pull over the block. The low friction wheel should not spin freely.

The chatter check consisted of the car being driven through eight (8) FIG. "8" lock to lock turns at 5 to 8 mph. A thirty-second stop was made before each check and after completing each circle. Any chatter, roughness or unusual noise was noted.

Four such tests were conducted. In one test, a "passing" reference gear oil (a GM factory fill for limited slip differentials) was used. In a second test, a "failing" reference oil (a GL-5 non-limited slip gear lubricant) was used. The other two tests involve use of an SAE 80W-90 gear oil base stock containing in both cases 5.5% of a commercially available fully formulated gear oil additive containing 23% by weight of sulfur, 2.2% by weight of phosphorus, and 0.4% by weight of nitrogen. In one test this gear oil was used as is. In the other test, the gear oil contained a formulation comparable to that of Example 31. The test results were as follows:

| Test No. | Composition | Results |
|---|---|---|
| 1 | "Passing" reference | Pass after 6000 miles |
| 2 | "Failing" reference | Fail after 1700 miles |
| 3 | Commercial Product | Fail after 2500 miles |
| 4 | This invention | Pass after 6000 miles |

This invention is susceptible to considerable variation within the spirit and scope of the appended claims, the forms presented hereinabove constituting preferred embodiments thereof.

What is claimed is:

1. A method of lubricating an automotive gear; said method comprising using as the lubricant for said automotive gear a gear oil composition which comprises a major proportion of at least one oil of lubricating viscosity and a minor amount of:

(a) at least one oil-soluble sulfur-containing extreme pressure or antiwear agent;

(b) at least one oil-soluble amine salt of a partial ester of an acid of phosphorus;

(c) at least one oil-soluble succinimide of the formula

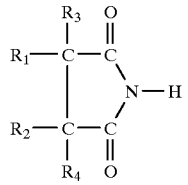

wherein $R_1$ is an alkyl or alkenyl group having an average of 14 to 30 carbon atoms, and each of $R_2$, $R_3$, and $R_4$ is, independently, a hydrogen atom or an alkyl or alkenyl group having an average of up to about 4 carbon atoms; and (d) at least one boron- and nitrogen-containing ashless dispersant; said gear oil composition being essentially devoid of any metal-containing additive component.

2. A method of lubricating an automotive gear according to claim 1 wherein said gear oil composition additionally contains a minor amount of at least one oil-soluble amine salt of a carboxylic acid.

3. A method of lubricating an automotive gear according to claim 1 wherein said gear oil composition additionally contains a minor amount of at least one oil-soluble trihydrocarbyl ester of a pentavalent acid of phosphorus.

4. A method of lubricating an automotive gear according to claim 1 wherein said gear oil composition additionally contains a minor amount of at least one oil-soluble amine salt of a carboxylic acid and a minor amount of at least one oil-soluble trihydrocarbyl ester of a pentavalent acid of phosphorus.

5. A method of lubricating an automotive gear according to claim 1 wherein said oil of lubricating viscosity is a mineral oil having a viscosity in the range of SAE 50 to SAE 250.

6. A method of lubricating an automotive gear according to claim 1 wherein said oil of lubricating viscosity is a mineral oil having a viscosity in the range of SAE 70W to SAE 140.

7. A method of lubricating an automotive gear according to claim 1 wherein wherein (a) is a sulfurized isobutene and (b) is an amine salt of a dialkylphosphorothioate.

8. A method of lubricating an automotive gear according to claim 1 wherein (a) is a sulfurized isobutene; (b) is an amine salt of a dialkylphosphorothioate; $R_1$ is alkenyl derived from isomerized olefins; and $R_2$, $R_3$, and $R_4$ are hydrogen.

9. A method of lubricating an automotive gear according to claim 1 wherein (a) is a sulfurized isobutene; (b) is an amine salt of a dialkylphosphorothioate; $R_1$ is alkenyl derived from isomerized olefins; and $R_2$, $R_3$, and $R_4$ are hydrogen.

10. A method of lubricating a manual transmission, said method comprising using as the lubricant for said manual transmission a lubricating oil composition comprising a major proportion of at least one oil of lubricating viscosity and a minor amount of:

(a) at least one oil-soluble sulfur-containing extreme pressure or antiwear agent;

(b) at least one oil-soluble amine salt of a partial ester of an acid of phosphorus;

(c) at least one oil-soluble succinimide of the formula

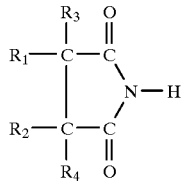

wherein $R_1$ is an alkyl or alkenyl group having an average of 14 to 30 carbon atoms, and each of $R_2$, $R_3$, and $R_4$ is, independently, a hydrogen atom or an alkyl or alkenyl group having an average of up to about 4 carbon atoms; and (d) at least one boron- and nitrogen-containing ashless dispersant; said lubricating oil composition being essentially devoid of any metal-containing additive component.

* * * * *